US007674209B2

(12) United States Patent
Greene

(10) Patent No.: US 7,674,209 B2
(45) Date of Patent: Mar. 9, 2010

(54) EXERCISE APPARATUS AND METHOD OF OPERATING THE SAME

(76) Inventor: Toni Greene, 2309 E. Euclid Ave., Milwaukee, WI (US) 53207

( * ) Notice: Subject to any disclaimer, the term of this patent is extended or adjusted under 35 U.S.C. 154(b) by 1621 days.

(21) Appl. No.: 10/909,183

(22) Filed: Jul. 30, 2004

(65) Prior Publication Data

US 2005/0026755 A1 Feb. 3, 2005

Related U.S. Application Data

(60) Provisional application No. 60/492,129, filed on Aug. 1, 2003.

(51) Int. Cl.
*A63B 21/02* (2006.01)

(52) U.S. Cl. ..... 482/121; 482/126; 482/123

(58) Field of Classification Search ..... 482/121, 482/126, 123, 129, 111, 128, 125, 140
See application file for complete search history.

(56) References Cited

U.S. PATENT DOCUMENTS

| | | | | |
|---|---|---|---|---|
| 1,023,756 | A * | 4/1912 | Pons | 482/128 |
| 4,103,524 | A | 8/1978 | Mitchell et al. | |
| 4,169,589 | A | 10/1979 | McArthur | |
| 4,304,110 | A | 12/1981 | Fain | |
| D316,026 | S | 4/1991 | Fuller | |
| 5,070,863 | A | 12/1991 | McArthur et al. | |
| 5,095,723 | A | 3/1992 | Lin | |
| D331,870 | S | 12/1992 | Fuller | |
| 5,169,363 | A | 12/1992 | Campanaro et al. | |
| D348,824 | S | 7/1994 | Hsu | |
| D349,839 | S | 8/1994 | Gilardelli | |
| D349,840 | S | 8/1994 | Fuller | |
| D350,472 | S | 9/1994 | White et al. | |
| 5,366,429 | A | 11/1994 | Jones | |
| 5,383,831 | A | 1/1995 | Drath | |
| 5,399,138 | A | 3/1995 | Jones | |
| D362,172 | S | 9/1995 | Lo | |
| D369,738 | S | 5/1996 | Hull, Jr. et al. | |
| D370,616 | S | 6/1996 | Fard | |
| 5,700,232 | A * | 12/1997 | Clausen et al. | 482/125 |
| 5,746,688 | A | 5/1998 | Prager | |
| D412,826 | S | 8/1999 | Calpito | |
| 5,951,448 | A | 9/1999 | Bolland | |
| 5,954,622 | A * | 9/1999 | Olschansky et al. | 482/123 |

(Continued)

FOREIGN PATENT DOCUMENTS

| | | | |
|---|---|---|---|
| GB | 2056866 | * | 3/1981 |

*Primary Examiner*—Jerome Donnelly
(74) *Attorney, Agent, or Firm*—Michael Best & Friedrich LLP

(57) ABSTRACT

An exercise apparatus and method of using exercise apparatuses. In some aspects and in some constructions, the invention may provide an exercise apparatus including a body housing a biasing member and having a first elongated member and a second elongated member movable relative to the first elongated member between a retracted position and an extended position, the biasing member biasing the second elongated member toward one of the retracted position and the extended position, a first pedal connected to the first elongated member, and a second pedal connected to the second elongated member, the first pedal being engageable by a first appendage of an operator and the second pedal being engageable by a second appendage of the operator for moving the second elongated member between the retracted position and the extended position.

16 Claims, 1 Drawing Sheet

U.S. PATENT DOCUMENTS 7,115,079 B2 * 10/2006 Yu ..... 482/126
2002/0016240 A1 * 2/2002 Conner ..... 482/125
2002/0111256 A1 * 8/2002 Tuller et al. ..... 482/140

* cited by examiner

EXERCISE APPARATUS AND METHOD OF OPERATING THE SAME

RELATED APPLICATIONS

The present application claims the benefit of prior-filed, provisional patent application Ser. No. 60/492,129, filed Aug. 1, 2003, the contents of which is hereby incorporated by reference.

FIELD OF THE INVENTION

The present invention relates to exercise equipment and to methods of exercising.

SUMMARY OF THE INVENTION

Conventional exercise equipment, such as free weights and nautilus machines, typically includes a support frame, one or more weights and/or a resistance member, such as a spring. An operator can exercise one or more muscles or muscle groups by moving the weights and/or the frame in a prescribed manner or, alternately, by moving at least a portion of the frame to overcome a force provided by the resistance member.

Conventional exercise equipment may be relatively bulky and, therefore, are not easily transported. Consequently, it is difficult for fitness-conscious individuals to travel with their exercise equipment. Also, to effectively use conventional exercise equipment, an operator typically must have a relatively large workout area, which is not always available, especially when the operator is traveling.

In addition, conventional exercise equipment, when used improperly, and, in some cases, even when used properly, can injure the operator.

Also, conventional exercise equipment is often prohibitively expensive. More particularly, some conventional exercise equipment is so expensive that many fitness-conscious individuals are unable to purchase the equipment and are only able to use the equipment at gyms and other public facilities.

In addition, conventional exercise equipment is often unable to exercise more than one muscle or muscle group. Therefore, to achieve a balanced workout and/or to exercise more than one muscle or muscle group, a fitness-conscious individual must own multiple pieces of exercise equipment.

The present invention provides an exercise apparatus, which substantially alleviates one or more independent problems with the above-described exercise equipment. In some aspects and in some constructions, the present invention provides an exercise apparatus generally including a body having a first elongated member and a second elongated member, the second elongated member being moveable relative to the first elongated member along a travel path between a retracted position and an extended position, a first pedal pivotably connected to the first elongated member for pivotable movement about a pivot axis relative to the first elongated member, the pivot axis extending through the first elongated member and being substantially perpendicular to the travel path, and a second pedal connected to the second elongated member.

In addition, in some aspects and in some constructions, the present invention provides an exercise apparatus generally including a body housing a biasing member and having a first elongated member and a second elongated member movable relative to the first elongated member between a retracted position and an extended position, the biasing member biasing the second elongated member toward one of the retracted position and the extended position, a first pedal connected to the first elongated member, and a second pedal connected to the second elongated member, the first pedal being engageable by a first appendage of an operator and the second pedal being engageable by a second appendage of the operator for moving the second elongated member between the retracted position and the extended position.

Also, in some aspects and in some constructions, the present invention provides a method of using an exercise apparatus. The exercise apparatus may generally include a body housing a biasing member and having a first elongated member and a second elongated member moveable with respect to the first elongated member along a travel path, the biasing member biasing the second elongated member in a first direction along the travel path, a first pedal connected to the first elongated member, and a second pedal connected to the second elongated member. The method may generally include the acts of engaging the first pedal with a first appendage of an operator, engaging the second pedal with a second appendage of the operator, applying a force to at least one of the first pedal and the second pedal to move the second elongated member in a second direction along the travel path, and removing the force from the at least one of the first pedal and the second pedal, the biasing member moving the second elongated member in the first direction along the travel path.

Independent features and independent advantages of the present invention will become apparent to those skilled in the art upon review of the following detailed description and drawings.

Figure 1:
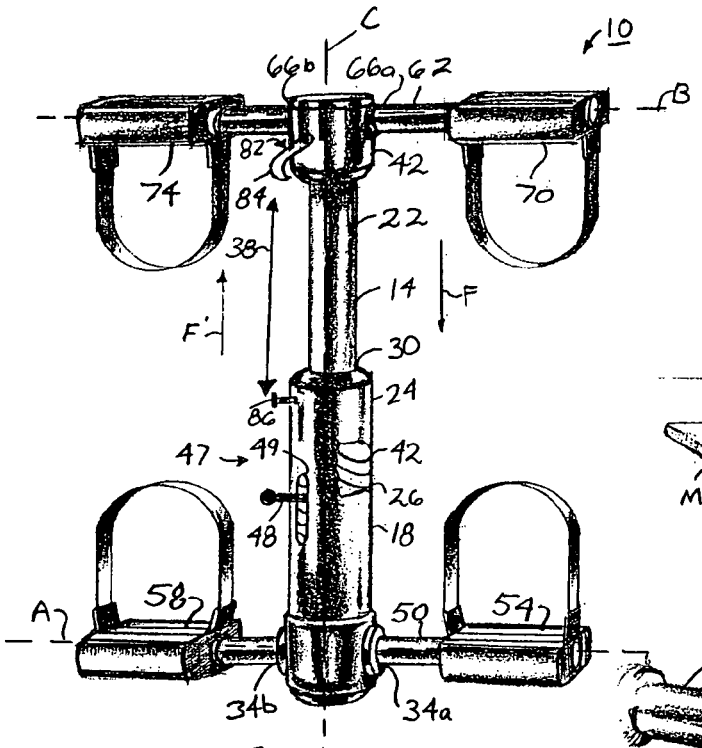
FIG. 1 is a side view of an exercise apparatus.

Before the various embodiments of the present invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that phraseology and terminology used herein with reference to device or element orientation (such as, for example, terms like "upper", "lower", etc.) are only used to simplify description of the present invention, and do not alone indicate or imply that the device or element referred to must have a particular orientation. The exercise apparatus referred to in the present invention can be transported, stored and operated in any orientation desired. In addition, terms such as "first" and "second" are used herein and in the appended claims for purposes of description and are not intended to indicate or imply relative importance or significance.

DETAILED DESCRIPTION

Figure 3:
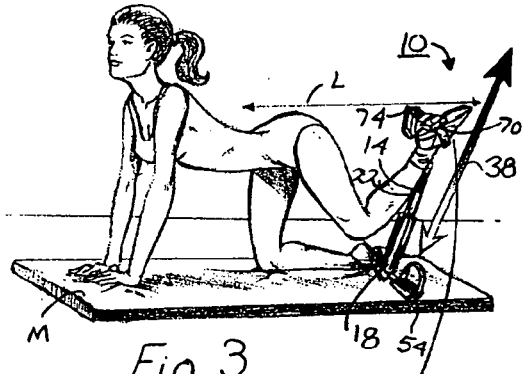
FIG. 3 is perspective view of an operator using the exercise apparatus shown in FIG. 1.
Figure 2:
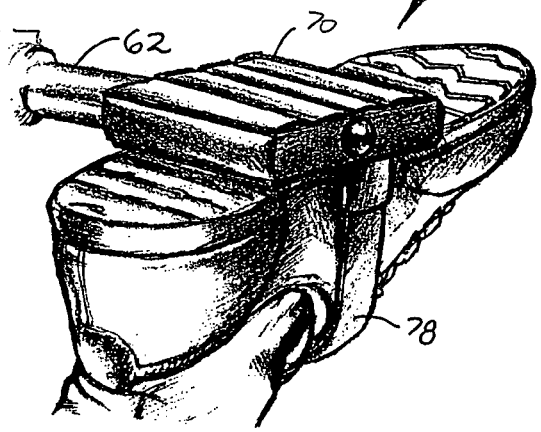
FIG. 2 is an enlarged perspective view of a portion of the exercise apparatus shown in FIG. 1.

An exercise apparatus 10 embodying independent aspects of the present invention is illustrated in FIGS. 1-3. As shown in FIG. 1, the exercise apparatus 10 includes a body 14 having a first elongated member 18 and a second elongated member 22. The first elongated member 18 includes a wall 24 at least partially defining an interior space 26 (partially shown in FIG. 1). An aperture 30 extends through an upper end (with reference to the orientation shown in FIGS. 1 and 3) of the first elongated member 18 and communicates with the interior space 26.

The second elongated member 22 extends through the aperture 30 in the first elongated member 18 and is movable in a telescoping manner relative to the first elongated member 18 along a substantially linear travel path (represented by arrow 38 in FIGS. 1 and 3) between a retracted position (not shown), an extended position (shown in FIGS. 1 and 3) and a number of intermediate positions (not shown). When the second elongated member 22 is in the retracted position, at least a portion of the second elongated member 22 is positioned in the interior space 26 of the first elongated member 18, and, when the second elongated member 22 is in the extended position, at least a portion of the second elongated member 22 extends outwardly (i.e., upwardly, with reference to the orientation shown in FIGS. 1 and 3) from the first elongated member 18.

As shown in FIGS. 1 and 3, the first and second elongated members 18, 22 can have substantially circular cross sections. However, in other aspects and in other constructions (not shown), the first elongated member 18 and/or the second elongated member 22 can have other cross sectional shapes, such as, for example, a rectangular, triangular, or other polygonal shape, an irregular shape, etc.

As mentioned above, the second elongated member 22 telescopingly engages the first elongated member 18 for movement between the retracted position, the extended position, and the intermediate positions. Accordingly, the length of the body 14 measured along the travel path 38 is adjustable. In some aspects and in the illustrated construction, the elongated body 14 has a length of between about two feet (i.e., when the second elongated member 22 is in the extended position) and about sixteen inches (i.e., when the first elongated member 18 is in the retracted position). However, in other aspects and in other constructions (not shown), the elongated body 14 can have other lengths.

In addition, in some aspects and in the illustrated construction, the length of the first elongated member 18 is substantially equal to the length of the second elongated member 22. However, in other aspects and in other constructions, the first and second elongated members 18, 22 can have different lengths. Also, while reference is made herein and in the figures to a body 14 having two telescopingly engageable elongated members 18, 22, in other aspects and in other constructions (not shown), the body 14 can have three, four or more telescopingly engageable elongated members.

In some aspects and in the illustrated construction, a flange (not shown) is connected to and extends radially outwardly from a lower end (with reference to the orientation shown in FIGS. 1 and 3) of the second elongated member 22. The outer perimeter of the flange is larger than the perimeter of the aperture 30 and, therefore, limits movement of the second elongated member 22 relative to the first elongated member 18 along the travel path 38 and secures the second elongated member 22 to the first elongated member 18.

As shown in FIG. 1, an upper portion 42 of the second elongated member 22 extends radially outwardly. In some aspects and in the illustrated construction of FIGS. 1 and 3, the outer diameter of the upper portion 42 of the second elongated member 22 is substantially larger than the diameter of the aperture 30 and, therefore, limits movement of the second elongated member 22 along the travel path 38. In other aspects and in other constructions (not shown), the second elongated member 22 may bottom-out against a rib or shelf in the first elongated member 18 to limit downward motion (with reference to the orientation shown in FIGS. 1 and 3) of the second elongated member 22 relative to the first elongated member 18 along the travel path 38.

In some aspects and in the illustrated construction, the second elongated member 22 is pivotable relative to the first elongated member 18 about an axis C extending through the first and second elongated members 18, 22 along the travel path 38 to provide more comfortable and/or more effective operation of the exercise apparatus 10.

The exercise apparatus 10 may also include a biasing member 46, such as, for example, a spring or another similar elastic element. In some aspects and in the illustrated construction, the biasing member 46 is a conventional coil spring having a first end connected to a portion of the first elongated member 18 (e.g., the wall 24 of the first elongated member 18) and a second end connected to a lower portion of the second elongated member 22.

In other aspects and in other constructions (not shown), the biasing member 46 may be a hydraulic member housed in one or both of the first and second elongated members 18, 22. In still other aspects and in other constructions (not shown), the interior space 26 of the first elongated member 22 may be substantially sealed and may house hydraulic fluid, such as water, air, oil, etc. In these aspects and in these constructions, the fluid biases the second elongated member 22 upwardly along the travel path 38 toward the extended position (shown in FIGS. 1 and 3) or, alternately, biases the second elongated member 22 downwardly along the travel path 38 toward the retracted position.

In some aspects and in the illustrated construction, the biasing member 42 applies a force (represented by arrow F in FIG. 1) to the second elongated member 22 to bias the second elongated member 22 toward the retracted position. Therefore, as described below, to operate the exercise apparatus 10, an operator must apply a force (represented by arrow F' in FIG. 1) that is greater than the force F of the biasing member 42 to the second elongated member 22 to move the second elongated member 22 along the travel path 38 from the retracted position to the extended position.

In other aspects and in other constructions (not shown), the biasing member 42 may apply a force to the second elongated member 22 to bias the second elongated member 22 toward the extended position (not shown). Therefore, to operate the exercise apparatus 10, an operator must apply a force that is greater than the force of the biasing member 42 to the second elongated member 22 to move the second elongated member 22 along the travel path 38 from the extended position toward the retracted position.

In some aspects and in some constructions, the exercise apparatus 10 also includes a force adjustment assembly 47 that is operably connected to the biasing member 42 to adjust the force F applied by the biasing member 42. For example, in the illustrated construction of FIG. 1, a lever or knob 48 extends outwardly through a slot 49 in the wall 24 of the first elongated member 18 and is connected to an end of the biasing member 42. By moving the lever 48 along the slot 49, an operator can alternately shorten or lengthen the biasing member 42 to adjust the force F applied by the biasing member 42.

As shown in FIG. 1, an arm 50 extends through openings 34*a*, 34*b* in the lower end of the first elongated member 18 (with reference to the orientation of the elongated member 18 as shown in FIGS. 1 and 3). The arm 50 supports pedals 54, 58 on either side of the first elongated member 18 and defines a first axis A, which is substantially perpendicular to the travel path 38. In some aspects and in some constructions, the pedals 54, 58 are connected to the arm 50 for pivoting movement about the first axis A and relative to the first elongated member 18. In this manner, an operator can adjust the orientation of the pedals 54, 58 with respect to the body 14 for more comfortable and/or for more effective operation of the exercise apparatus 10, as described below.

In some aspects and in the illustrated construction, a second arm 62 extends through openings 66*a*, 66*b* in the second elongated member 22. As shown in the construction of FIG. 1, arm 62 is substantially parallel to arm 50 and defines a second axis B, which is substantially perpendicular to the travel path 38. Arm 62 supports pedals 70, 74 on either side of the second elongated member 22. In some aspects and in some constructions, the pedals 70, 74 are connected to the arm 62 for pivoting movement about the second axis B and relative to the second elongated member 22. In this manner, an operator can adjust the orientation of the pedals 70, 74 with respect to the body 14 for more comfortable and/or more effective operation of the exercise apparatus 10, as described below.

As shown in FIGS. 1-3, the pedals 54, 58, 70, 74 include straps 78. Opposite ends of the straps 78 are secured to pedals 54, 58, 70, 74 to form an opening for an operator's appendage (e.g., a foot, a leg, an arm, or a hand). The straps 78 are adjustable to engage the operator's appendage as desired for a particular exercise and to maintain the appendage in a desired position with respect to the pedals 54, 58, 70, 74 during operation of the exercise apparatus 10. For example, in some aspects and in some constructions, the straps 78 include VELCRO®, buckles, snaps or other similar adjustable fasteners.

In some aspects and in some constructions, the exercise apparatus 10 also includes a locking assembly 82 that secures the second elongated member 22 in a position relative to the first elongated member 18. In the illustrated construction of FIG. 1, the locking assembly 82 is operable to secure the second elongated member 22 in the retracted position for convenient and more compact shipping or storage. In other constructions, the locking assembly 82 can also or alternately secure the second elongated member 22 in the extended position and/or in one or more intermediate positions between the retracted position and the extended position.

As shown in FIG. 1, in some aspects and in some constructions, the locking assembly 82 includes a hook or latch 84 connected to the second elongated member 18 and pivotable relative to the second elongated member 22 between a locking position, in which the latch 84 lockingly engages a protrusion 86 on the first elongated member 22, and an unlocking position, in which the latch 84 is disconnected from the protrusion 86. In another construction (not shown), the locking assembly 82 may include a hook or latch 84 connected to the first elongated member 22 and pivotable between a locking position, in which the latch 84 lockingly engages a protrusion 86 on the second elongated member 22, and an unlocking position, in which the latch 84 is disconnected from the protrusion 86.

The exercise apparatus 10 of the present invention can be used to perform a number of different and mutually exclusive exercises to exercise or work a number of different muscles or muscle groups. For example, in a first application and as shown in FIG. 3, an operator kneels down on the floor or a mat M and positions her first foot (e.g., her right foot) on one of pedals 54, 58 (e.g., pedal 58) under the strap 78. The operator then adjusts the strap 78 as needed to snuggly engage her first foot (e.g., her right foot). The operator then positions her second foot (e.g., her left foot) on one of pedals 70, 74 (e.g., pedal 74) and adjusts the strap 78 as necessary. The operator then places her hands firmly on the floor or mat M and arches her back.

Once the operator has oriented herself in the prescribed position, she applies a force F' to the pedal 70 with her second foot (e.g., her left foot) while maintaining her first foot (e.g., her right foot) on the mat M. By applying the force F', the operator overcomes the downward force F of the biasing member 42 and moves the second elongated member 22 upwardly (with reference to the orientation shown in FIG. 3) along the travel path 38 toward the extended position or, alternately, to a position substantially equal to the height of a line L extending horizontally through her shoulders and buttocks. The operator then relaxes her muscles and slowly returns the second elongated member 22 to the retracted position. The operator can then repeat this process as necessary to tone and strengthen muscles in her gluteus area, including the gluteus maximus, quadriceps, and hamstrings. The operator can then reorient herself to work or exercise other muscles in her body.

For example, the operator can position her second foot (e.g., her left foot) on one of pedals 54, 58 (e.g., pedal 54) under the strap 78. The operator then adjusts the strap 78 as needed to snuggly engage her second foot (e.g., her left foot). The operator then positions her first foot (e.g., her right foot) on one of pedals 70, 74 (e.g., pedal 70) and adjusts the straps 78 as necessary. The operator then orients herself as described above with her hands and knees on the mat M. Once the operator has oriented herself in the prescribed position, she moves the second elongated member 22 upwardly along the travel path 38 toward the extended position by pushing upwardly with her first foot (e.g., her right foot) while maintaining her second foot (e.g., her left foot) on the floor or mat M. The operator then moves the second elongated member 22 to the extended position or, alternately, the operator moves the second elongated member 22 to a position substantially equal to the height of the line L extending horizontally from her shoulder to her buttocks. The operator then slowly returns the second elongated member 22 to the retracted position.

In another application, the operator sits down in a chair or on the mat M and places pedals 54, 58 under her knees. The operator then tightens the straps 78 around her legs and grasps the undersides of pedals 70, 74 with her right and left hands so that her palms are facing upwardly. The operator then pivots her upper arms about her elbows toward her chest and applies a force F' to the pedals 70, 74 to force the second elongated member 22 upwardly along the travel path 38 toward the extended position and to overcome the downward force F of the biasing member 42. The operator then relaxes her arm muscles and returns the second elongated member 22 to the retracted position. The operator can repeat this process as necessary to tone and strengthen muscles in her arms and chest, including her biceps, triceps, and deltoids.

Although particular constructions of the present invention have been shown and described, other alternative constructions will be apparent to those skilled in the art and are within the intended scope of the present invention.

What is claimed is:

1. An exercise apparatus comprising:

a body having a first elongated member and a second elongated member, the second elongated member being moveable relative to the first elongated member along a travel path between a retracted position and an extended position;

a first pedal pivotably connected to the first elongated member for pivotable movement about a pivot axis relative to the first elongated member, the pivot axis extending through the first elongated member and being substantially perpendicular to the travel path;

a second pedal connected to the second elongated member; and a biasing member biasing the second elongated member toward one of the retracted position and the extended position;

wherein the biasing member applies a force to the first elongated member and second elongated member to bias the second elongated member toward the one of the retracted position and the extended position, and wherein the biasing member is adjustable to change the force; and wherein the first elongated member includes a wall defining an interior space, the wall having a slot extending therethrough and communicating with the interior space, wherein at least a portion of the biasing member is housed in the interior space, and further comprising an adjustment lever extending through the slot and being connected to the biasing member, the adjustment lever being moveable along the slot to change the force.

2. The exercise apparatus of claim 1, wherein at least one of the first pedal and the second pedal includes a strap for engagement by an appendage of an operator.

3. The exercise apparatus of claim 2, wherein the strap is adjustable to accommodate differently sized appendages.

4. The exercise apparatus of claim 1, and further comprising a locking arrangement moveable between a locking condition, in which the locking arrangement secures the second elongated member in one of the retracted position and the extended position, and an unlocking condition, in which the second elongated member is movable between the retracted position and the extended position.

5. The exercise apparatus of claim 4, wherein the locking arrangement includes a latch supported on one of the first elongated member and the second elongated member and engageable with an other of the first elongated member and the second elongated member to secure the second elongated member in the one of the retracted position and the extended position.

6. The exercise apparatus of claim 1, wherein at least one of the first pedal and the second pedal is pivotable relative to the body about an axis extending through the body along the travel path.

7. The exercise apparatus of claim 1, wherein at least one of the first pedal and the second pedal is engageable by an appendage of an operator for moving the second elongated member along the travel path.

8. The exercise apparatus of claim 1, wherein the second pedal is pivotably connected to the second elongated member for pivotable movement about a second pivot axis relative to the second elongated member, the second pivot axis extending through the second elongated member and being substantially perpendicular to the travel path.

9. An exercise apparatus comprising:

a body housing a biasing member and having a first elongated member and a second elongated member movable relative to the first elongated member between a retracted position and an extended position, the biasing member biasing the second elongated member toward one of the retracted position and the extended position;

a first pedal connected to the first elongated member; and a second pedal connected to the second elongated member, the first pedal being engageable by a first appendage of an operator and the second pedal being engageable by a second appendage of the operator for moving the second elongated member between the retracted position and the extended position;

wherein the biasing member applies a force to the first elongated member and the second elongated member to bias the second elongated member toward the one of the retracted position and the extended position, and wherein the biasing member is adjustable to change the force; and wherein the first elongated member includes a wall defining an interior space, the wall having a slot extending therethrough and communicating with the interior space, wherein at least a portion of the biasing member is housed in the interior space, and further comprising an adjustment lever extending through the slot and being connected to the biasing member, the adjustment lever being moveable along the slot to change the force.

10. The exercise apparatus of claim 9, wherein at least one of the first pedal and the second pedal includes an appendage strap.

11. The exercise apparatus of claim 10, wherein the strap is adjustable to accommodate differently sized appendages.

12. The exercise apparatus of claim 9, and further comprising a locking arrangement moveable between a locking condition, in which the locking arrangement secures the second elongated member in an other of the retracted position and the extended position, and an unlocking condition, in which the second elongated member is movable between the retracted position and the extended position.

13. The exercise apparatus of claim 12, wherein the locking arrangement includes a latch supported on one of the first elongated member and the second elongated member and engageable with an other of the first elongated member and the second elongated member to secure the second elongated member in the other of the retracted position and the extended position.

14. The exercise apparatus of claim 9, wherein the second elongated member moves along a travel path between the retracted position and the extended position, and wherein at least one of the first pedal and the second pedal is pivotable relative to the body about an axis extending through the body along the travel path.

15. The exercise apparatus of claim 9, wherein the second elongated member moves along a travel path between the retracted position and the extended position, and wherein the first pedal is pivotably connected to the first elongated member for pivotable movement about a pivot axis relative to the first elongated member, the pivot axis extending through the first elongated member and being substantially perpendicular to the travel path.

16. The exercise apparatus of claim 15, wherein the second pedal is pivotably connected to the second elongated member for pivotable movement about a second pivot axis relative to the second elongated member, the second pivot axis extending through the second elongated member and being substantially perpendicular to the travel path.

* * * * *